United States Patent [19]

Weber

[11] Patent Number: 4,655,504

[45] Date of Patent: Apr. 7, 1987

[54] STACKABLE CHAIR WITH GANGING STRUCTURE

[76] Inventor: Jay B. Weber, 590 Valley View Dr., New Holland, Pa. 17557

[21] Appl. No.: 759,867

[22] Filed: Jul. 29, 1985

[51] Int. Cl.[4] ..... A47C 3/04

[52] U.S. Cl. ..... 297/239; 297/248; 297/426

[58] Field of Search ..... 297/239, 248, 425, 426, 297/187; 108/64

[56] References Cited

U.S. PATENT DOCUMENTS

| | | | |
|---|---|---|---|
| 3,084,977 | 4/1963 | Chapman | 297/248 |
| 3,620,567 | 11/1971 | Hendrickson | 297/248 |
| 3,784,251 | 1/1974 | Persson et al. | 297/239 |
| 3,856,352 | 12/1974 | Jacobi | 297/239 |
| 4,218,089 | 8/1980 | Beltrami et al. | 297/248 |

FOREIGN PATENT DOCUMENTS

| | | | |
|---|---|---|---|
| 675916 | 7/1952 | United Kingdom | 297/239 |
| 1278727 | 6/1972 | United Kingdom | 297/248 |

*Primary Examiner*—Francis K. Zugel

*Attorney, Agent, or Firm*—Larry W. Miller

[57] ABSTRACT

A chair construction is disclosed wherein the leg members can be intermeshed with the leg members of adjoining chairs to form a row of chairs, such as used for a church pew. Each leg member is composed of a support portion and an integral ganging portion which have surfaces diverging from an interior apex to form an axially extending groove. This groove is of a size and shape to snugly receive the ganging portion of the mating leg member to form a solid joint when the adjoining leg members are interengaged. The leg members are externally connected to the seat member to permit a vertical stacking of the individual chairs to facilitate storage thereof. The rear leg members are constructed with a hole and corresponding bayonet joint to detachably receive an optional kneeler that can be pivotally moved into a retracted position.

7 Claims, 7 Drawing Figures

39
29
41
43
48

39
24
44
41
47
35
27
41
25
38
33
39
31
22
20
33
38
41
31
36
39
37
35

50
33
31
49
4
48
4
35
29
43
31
36
35
39
41
38
33
49
5
47
5
24
44

STACKABLE CHAIR WITH GANGING STRUCTURE

BACKGROUND OF THE INVENTION

The present invention relates generally to the construction of chairs and, more particularly, to improvements in the construction of leg members to permit an interlocking of the leg members of adjoining chairs to form a row of chairs.

Previous attempts at providing a chair construction to permit a ganging of individual chairs to form a row of chairs have been awkward to use in the assembly and disassembly of rows of chairs. For example, pin and slot structures as found in U.S. Pat. No. 3,127,218, require a precise lifting and manipulation of the chair to engage the pin with the slotted hole for receipt thereof. Other devices such as seen in U.S. Pat. No. 3,144,271 connect only small portions of adjoining leg members and do not provide a solid connection therebetween. Furthermore, ganging structures of this type protrude outwardly from the leg members and can be cumbersome when utilizing the chair as a discrete unit. Other devices, such as seen in U.S. Pat. Nos. 4,341,419 and 3,784,251, require substantial movement of the individual chairs to effect an intermeshing thereof when forming a row of chairs and, furthermore, do not lend themselves for construction from wooden materials.

Accordingly, it would be desirable to provide a chair construction that would permit the individual chairs to be made from wood and be easily connected to form a row of chairs solidly joined together without cumbersome ganging structure.

SUMMARY OF THE INVENTION

It is an object of this invention to overcome the aforementioned disadvantages of the prior art by providing a chair construction with a seat member having leg members externally connected thereto and having an integral ganging structure extending along the entire axial length of the leg.

It is another object of this invention to provide a leg member having a support portion and an integral ganging portion having surfaces diverging from an internal apex to form an axial groove therebetween.

It is a feature of this invention that the axial groove has a size and shape to snugly receive the ganging portion of an adjoining mating chair leg.

It is another feature of this invention that the axial groove is defined by a fore-and-aft extending surface of said support portion and an obliquely extending surface of said ganging portion diverging from an interior apex.

It is an advantage of this invention that the leg members can be made of wood without sacrificing the strength and integrity of the leg member or the chair.

It is another advantage of this invention that the interlocked chair legs form a solid joint therebetween to permit a secure formation of a row of chairs.

It is another feature of this invention that the ganging structure is integrally formed along the entire length of the chair leg as an integral part thereof.

It is another advantage of this invention that the chairs require minimal vertical movement to affect an intermeshing of adjacent chair legs.

It is yet another object of this invention to provide a ganging portion that forms a solid joint along the entire length of the chair leg to provide a solid connection between adjoining chair legs.

It is a further object of this invention to provide a chair leg construction having structure to permit a ganging of adjacent chair legs that lends itself to construction from wooden materials.

It is still another feature of this invention that the individual chairs can be compactly stacked vertically to facilitate storage thereof.

It is yet another feature of this invention that the seat member is provided with a storage compartment that can be accessed from either in front or behind the chair.

It is still another advantage of this invention that the rear chair legs can be adapted for selectively receiving an optional structure, such as a kneeler.

It is yet another feature of this invention that a plurality of chairs can be interconnected to form a church pew of a selectable length.

It is yet a further object of this invention to provide a stackable chair with ganging structure which is durable in construction, inexpensive of manufacture, carefree of maintenance, facile in assemblage, and simple and effective in use.

These and other objects, features and advantages are accomplished according to the instant invention by providing a chair construction wherein the leg members can be intermeshed with the leg members of adjoining chairs to form a row of chairs, such as used for a church pew. Each leg member is composed of a support portion and an integral ganging portion which have surfaces diverging from an interior apex to form an axially extending groove. This groove is of a size and shape to snugly receive the ganging portion of the mating leg member to form a solid joint when the adjoining leg members are interengaged. The leg members are externally connected to the seat member to permit a vertical stacking of the individual chairs to facilitate storage thereof. The rear leg members are constructed with a hole and corresponding bayonet joint to detachably receive an optionally kneeler that can be pivotal moved into a retracted position.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 2:
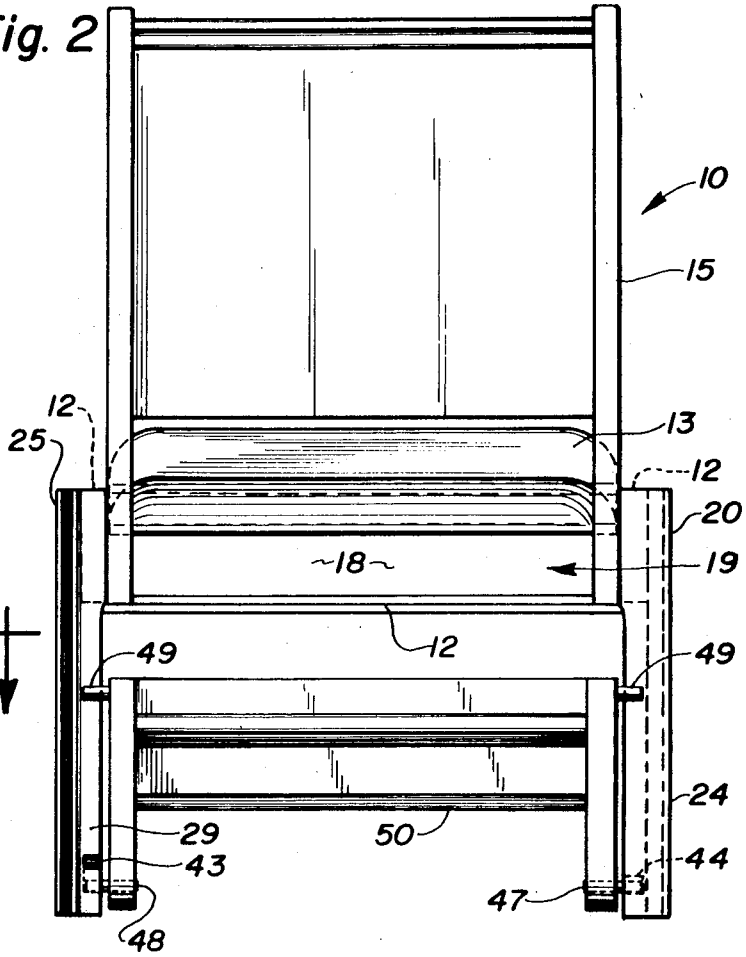
FIG. 2 is a rear elevational view of the chair seen in FIG. 1.
Figure 1:
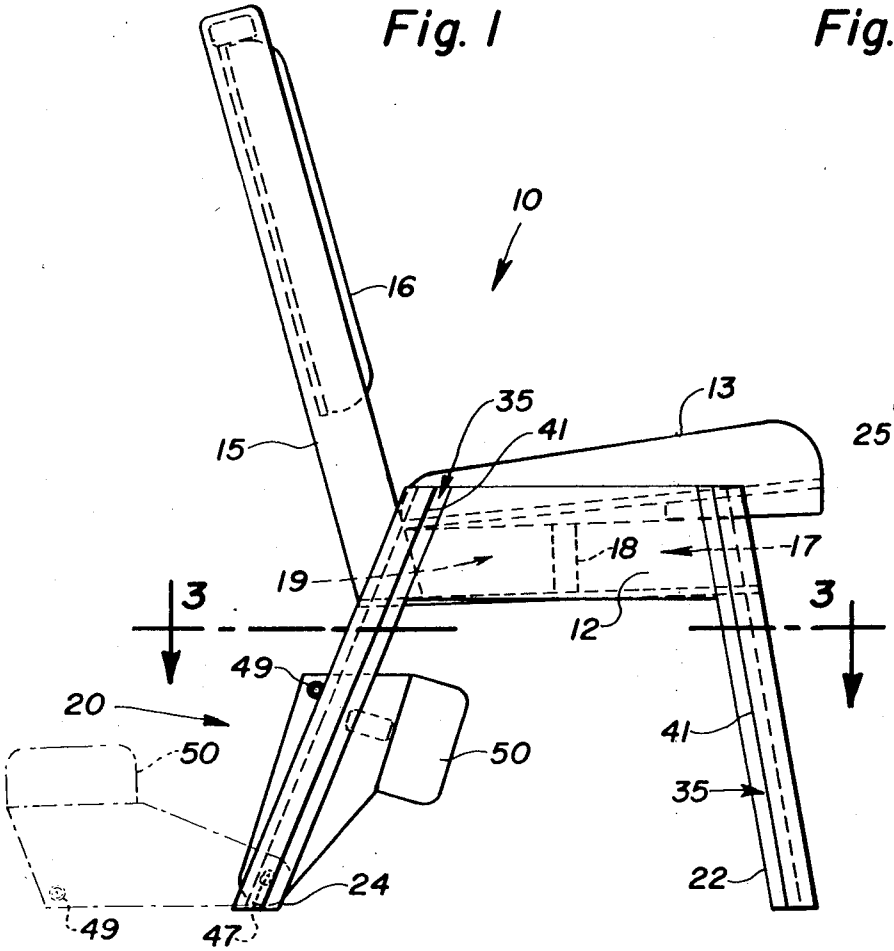
FIG. 1 is a right side elevational view of a chair incorporating the principles of the instant invention, an optional kneeler attachment being shown in its retracted position, the movement thereof being shown in phantom.

Referring now to the drawings and, particularly, to FIG. 1, a right side elevational view of a chair incorporating the principles of the instant invention can be seen. Any left or right references are used as a matter of convenience and are determined by standing at the rear of the chair, facing the seat back. The chair 10 includes a seat member 12 supporting a seat cushion 13. A seat back 15 is connected to the seat member 12 in a conventional manner and supports a padded seat back 16 to provide comfort to the occupant. Front and rear storage compartments 17,19, respectively, are formed in the seat member 12 for access from in front of or behind the chair 10. A divider 18 can be provided to separate the storage compartments 17,19. Referring to FIGS. 1 and 2, the seat member 12 is supported in an elevated position by first and second pair of leg members 20,25, positioned along the right and left sides, respectively, of the seat member 12.

Figures 3, 4, 5:
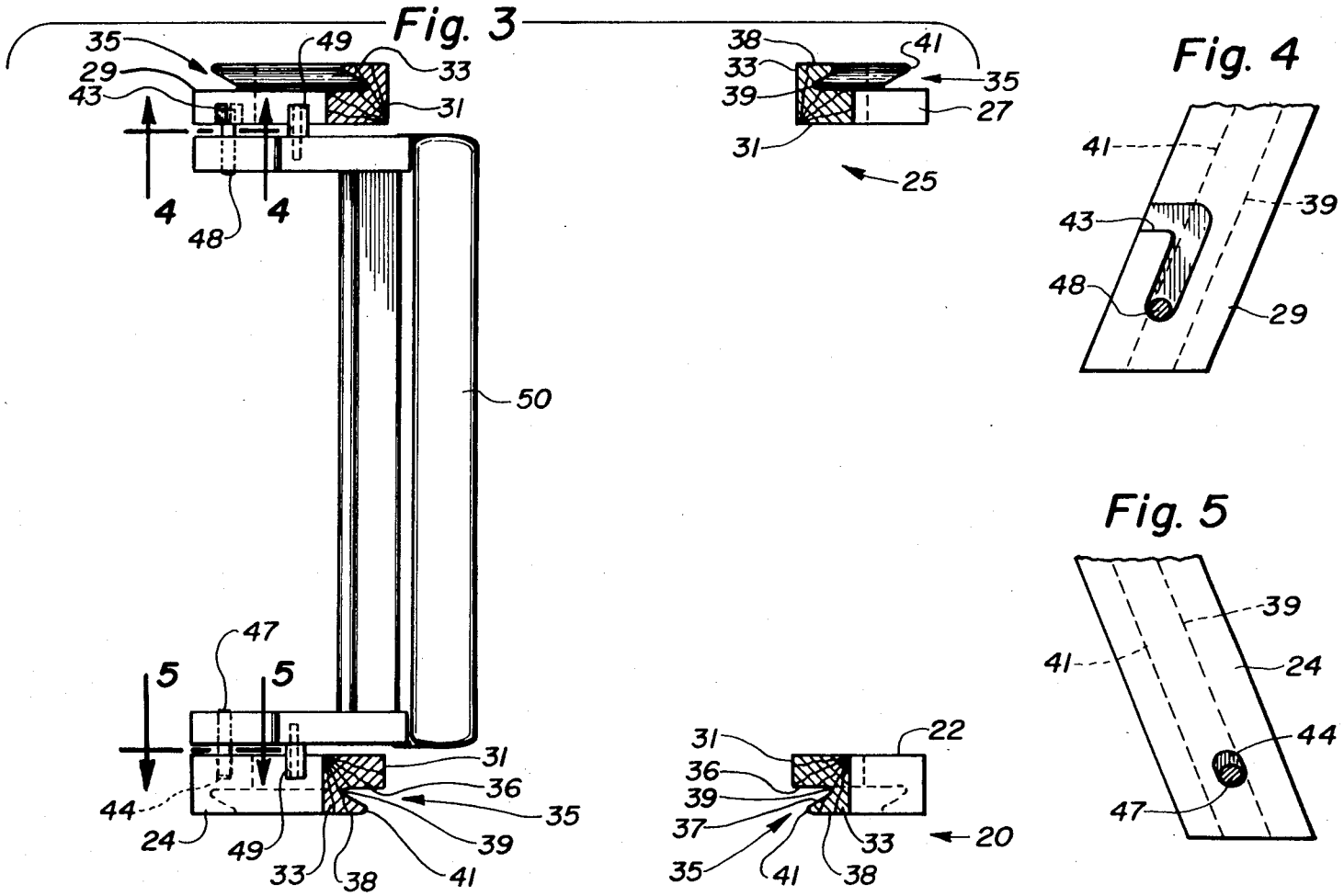
FIG. 3 is a cross-sectional view of the chair taken along lines 3—3 of FIG. 1.
FIG. 4 is a cross-sectional detail view taken along lines 4—4 of FIG. 3 to show the bayonet joint in the left rear leg to facilitate a selective attachment of the optional kneeler.
FIG. 5 is a cross-sectional detail view taken along lines 5—5 of FIG. 3 to show the hole in the right rear leg for receiving the optional kneeler attachment.

As best seen in FIGS. 1–3, each pair of leg members 20,25 includes a front leg 22,27 and a rear leg 24,29 inclined from a vertical orientation so that the axis defining the length of each respective leg member is inclined toward the opposing leg of the respective pair. The connection of the respective leg members 22,24,27,29 to the exterior of the seat member 12, which is in a conventional manner, is such that the axes of the legs in each respective pair converge upwardly, permitting the individual chairs to be stacked vertically in a compact manner as will be readily realized by one skilled in the art.

Figure 6:
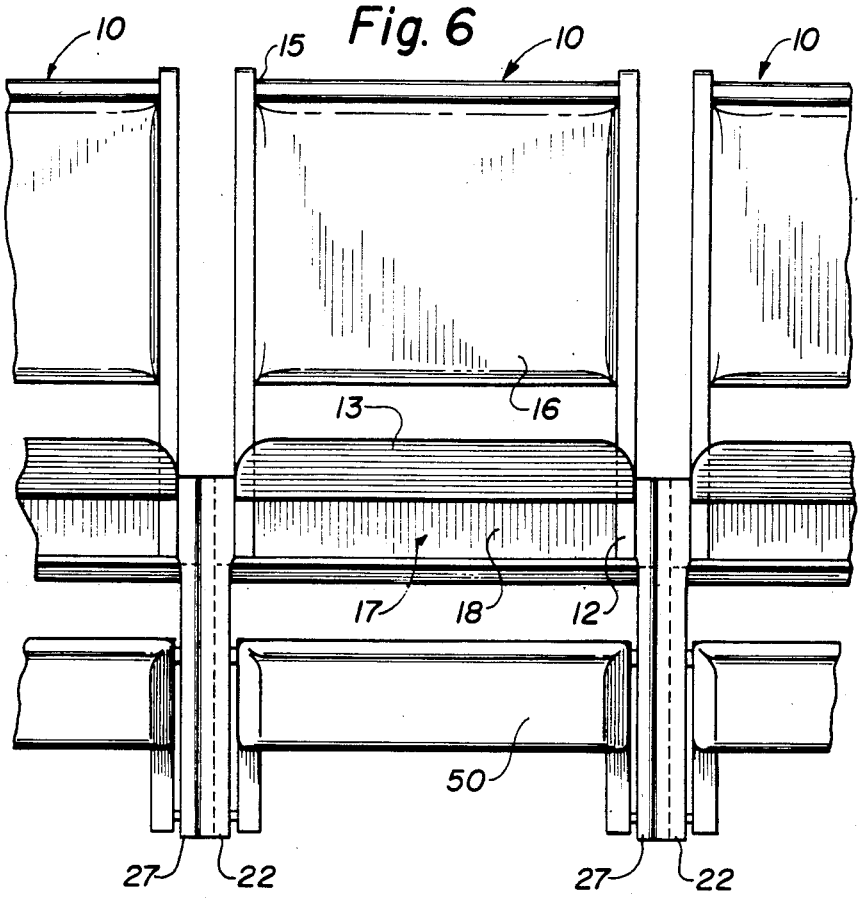
FIG. 6 is a front elevational view of a portion of a row of chairs interconnected according to the principles of the instant invention.
Figure 7:
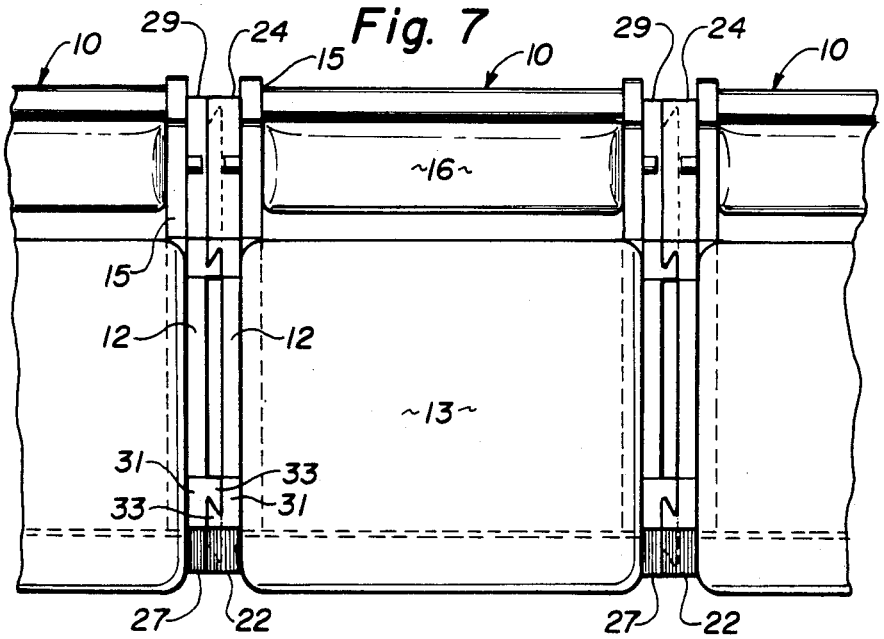
FIG. 7 is a top plan view of the row of chairs seen in FIG. 6.

The configuration of each respective leg member and the orientation thereof, as will be described in further detail below, permits individual chairs to be interconnected to form a row of chairs, as can be seen in FIGS. 6 and 7. As best shown in FIG. 3, each leg member 22,24,27,29 includes a support portion 31 and an integral ganging portion 33. A groove 35 defined by a fore-and-aft extending surface 36 of the support portion 31 and the obliquely extending surface 37 of the ganging portion 33, which meet at an internal apex 39, is formed within the respective leg member between the support portion 31 and the ganging portion 33. The size and shape of the groove 35 corresponds to the size and shape of the ganging portion 33 of the corresponding leg of the opposing pair of legs, which is defined by the obliquely extending surface 37 and the exterior surface 38, which meet at an external apex 41, permitting a mating of adjacent, opposing pairs of chair legs to form the interlocked row of individual chairs 10 shown in FIGS. 6 and 7. The angular displacement of the internal apex 39 is substantially equal to the exterior apex 41.

The grooves 35 of the right pair of leg members 20 are directed toward each other and, consequently, face downwardly toward the surface on which the leg members are resting. The grooves 35 of the left pair of leg members 25 are directed away from each other and, consequently, face upwardly to receive the ganging portions 33 of the right pair of legs 20 of an adjacent chair 10 to permit a ganging of individual chairs. The obliquely extending surface 37 extending from the interior apex 39 to the exterior apex 41 effects a solid jointure of interlocked leg members and, since the groove 35 extends along the entire axial length of the respective chair leg, the interlocked joint provides a solid connection between adjoining chairs 10 to form a stable row of chairs. This specific leg member construction can be easily made from wood without sacrificing strength as the entire leg member as both the support portion 31 and the ganging portion 33 engage the base surface to support the weight of the occupant and the chair 10. The widening shape of the ganging portion 33 allows a strong joint between interlocking chair legs without sacrificing the integrity of the ganging portion 33.

As best seen in FIGS. 4 and 5, the rear legs 24,29 have been adapted for receipt of an optional attachment, such as the kneeler 50. The left rear leg 29 is constructed with a bayonet joint 43 in the form of an inverted L-shaped groove cut into the interior side of the left rear leg 29. The right rear leg 24 has a hole 44 drilled into the interior side thereof to correspond to the bottom of the bayonet joint 43 in the left rear leg 29. A first dowel 47 extending outwardly from the kneeler 50 can be positioned within the hole 44 in the right rear leg 24, followed by the positioning of a second dowel 48 into the bayonet joint 43 in the left rear leg 29, permiting the kneeler 50 to be selectively attached to the chair 10. A pair of stops 49 projecting outwardly from the kneeler 50 will engaging the rear legs 24,29 when the kneeler 50 is positioned within its retracted position, shown in solid lines in FIG. 1, to permit the kneeler 50 to be positioned underneath the chair and out of the way when not in use. The pivotal movement of the kneeler 50 about the dowels 47,48 will permit the kneeler 50 to be moved into a use position, as shown in phantom in FIG. 1, whenever desired.

Referring now to FIGS. 3, 6 and 7, the ganging of individual chairs to form a solid row of chairs for use as church pews, for example, can best be seen. Because of the angled relationship of the front and rear legs of each pair 20,25, and the specific construction of each respective chair leg 22,24,27,29, as described above, adjacent chairs can be interlocked by lifting one chair so that the right pair of legs thereof can be lifted over the left pair of legs 25 of the adjacent chair until the ganging portions 33 of the right pair of legs 20 of the elevated chair are aligned with the grooves 35 of the left pair of legs 25 of the adjacent chair. A subsequent lowering of the elevated chair will affect a mating of corresponding chair legs, interlocking adjoining pairs of legs in a snug jointure along the entire length of the respective legs to form a solid, stable row of chairs that will not result in any respective movement therebetween. Disassembly of a row of chairs can be accomplished in the reverse manner by lifting the right pair of legs 20 off the adjacent left pair of legs 25 of the adjoining chair until the adjacent leg assemblies can be disengaged.

One skilled in the art will readily realize that this specific chair construction requires only a relatively small amount of vertical movement to affect a ganging of adjacent chairs by reason that the fore-and-aft width of the ganging portions terminating at the respective exterior apex is less than the fore-and-aft width of the support portions; therefore, adjacent pairs of legs can be engaged whenever the maximum distance between respective exterior apexes of the elevated right pair of legs is greater than the distance between respective exterior apexes of the left pair of legs to be engaged. For a chair as shown in the drawings, it is only necessary to lift the chair a distance of less than two inches to enable adjacent chairs to be ganged together to form a row of interconnected chairs. One skilled in the art will further realize that the ganging structure is an integral part of the respective leg and does not project cumbersomely to detract from the use of the chair as an individual piece of furniture. Also, since the width of the seat back 15 is less than the transverse spacing of the rear legs 24,29, the individual chairs can be vertically stacked in a compact manner to facilitate storage thereof.

It will be understood that changes in the details, materials, steps and arrangement of parts which have been described and illustrated to explain the nature of the invention will occur to and amy be made by those skilled in the art upon a reading of this disclosure within the principles and scope of the invention. The foregoing description illustrates the preferred embodiment of the invention; however, concepts, as based upon the description may be employed in other embodiments without departing from the scope of the invention. Accordingly, the following claims are intended to protect the invention broadly, as well as in the specific form shown.

Having thus described the invention, what is claimed is:

1. A chair having a seat portion supported in an elevated position by first and second pairs of legs affixed thereto, each said pair of legs having a front leg and a rear leg defining leg axes inclined from a vertical orientation and disposed in an upwardly converging relationship, each said leg having a support portion and an axially extending integral ganging portion, the ganging portions of corresponding legs of said first and second pairs of legs being oppositely disposed to permit a selective interengagement thereof between adjacent chairs to form a row of interlocked chairs, one of said rear legs being provided with a hole therein, the other of said rear legs having a bayonet joint in the form of an inverted L-shaped groove formed therein to permit the selective attachment of a kneeler member to said chair by pins positionable within said hole and said bayonet joint to enable said kneeler to be pivotally moved between a retracted position and a use position.

2. The chair of claim 1 wherein said legs are connected externally of said seat portion to permit said chairs to be stacked vertically.

3. The chair of claim 2 wherein said ganging portions diverge from said support portions to form axially extending grooves in each of said legs.

4. The chair of claim 3 wherein said grooves in said first pair of legs face inwardly toward the opposing said leg, the grooves of said second pair of legs facing outwardly away from the opposing said leg.

5. The chair of claim 4 wherein each said groove is defined by obliquely extending surfaces respectively of said support portion and said ganging surface.

6. The chair of claim 5 wherein the ganging portion of one leg is received within the groove of the adjoining leg when adjacent chairs are interengaged to form a row of chairs to form a tight joint therebetween, the ganging portion of said one leg being of mating size and shape with respect to the groove of the corresponding leg of the opposing pair of legs.

7. The chair of claim 6 wherein said pairs of legs are disposed such that a vertical movement of one chair relative to an adjacent chair ganged thereto of a magnitude less than one quarter of the axial length of said legs will permit a disengagement of said ganged chairs.

* * * * *